United States Patent [19]

Bertram

[11] Patent Number: 4,624,376

[45] Date of Patent: Nov. 25, 1986

[54] ADJUSTABLE WIRE SHELF AND BRACKET

[75] Inventor: Paul F. Bertram, St. Louis, Mo.

[73] Assignee: Lee-Rowan Company, St. Louis, Mo.

[21] Appl. No.: 561,895

[22] Filed: Dec. 15, 1983

[51] Int. Cl.[4] ..... A47F 43/00

[52] U.S. Cl. ..... 211/187; 248/250; 108/152

[58] Field of Search ..... 211/187, 153, 181, 190, 211/192, 193, 90, 106; 108/154, 152; 248/247, 248, 250

[56] References Cited

U.S. PATENT DOCUMENTS

| | | | |
|---|---|---|---|
| 438,280 | 10/1890 | Wright | 211/90 X |
| 2,644,591 | 7/1953 | McMahan | 211/187 X |
| 3,194,528 | 7/1965 | Chesley | 248/250 |
| 3,353,684 | 11/1967 | Chesley | 211/187 |
| 3,730,108 | 5/1973 | Stroh | 211/181 X |
| 3,765,634 | 10/1973 | Stempel | 248/250 |
| 4,316,593 | 2/1982 | Miner et al. | 211/90 X |
| 4,361,099 | 11/1982 | Kokenge et al. | 108/152 |
| 4,374,498 | 2/1983 | Yellin | 108/152 X |

*Primary Examiner*—Ramon S. Britts
*Assistant Examiner*—Sarah A. Lechok Eley
*Attorney, Agent, or Firm*—Rogers, Howell, Moore & Haferkamp

[57] ABSTRACT

An adjustable wire shelf has a flanged bracket mounted in perforated channel supports. The flanged bracket has a relieved portion at the rear extremity, trapping the rear edge of the shelf against the perforated channel. The front edge of the shelf has a depending portion which traps the front edge of the bracket. The bracket may also support intermediate shelf wires.

10 Claims, 5 Drawing Figures

ADJUSTABLE WIRE SHELF AND BRACKET

BACKGROUND AND SUMMARY OF THE INVENTION

This invention relates to adjustable shelving and, in particular, to adjustable shelving of the type in which brackets are mounted in perforated vertical supports and may be adjusted in the vertical direction by selection of particular perforated areas in the supports. The invention further relates to moveable shelving of the type in which the shelf is formed of a wire structure.

Applicant is aware of the following U.S. Patents relating to wire shelving and bracketing, the disclosures of which are incorporated by reference herein:

U.S. Pat. No. 3,627,247
U.S. Pat. No. 3,730,467
U.S. Pat. No. 4,109,979
U.S. Pat. No. 4,122,955
U.S. Pat. No. 4,211,443

Adjustable shelving of the type using a clip-in blade-like shelf bracket adjustably fitting into vertical wall mounted supports is well known in the art. Such shelving finds a high degree of utilization, since it is readily adjustable, may be installed easily, and may be conveniently moved to new locations or removed by removing simple screw fasteners. Such devices and assemblies have a drawback, however, in that they tend to be easily displaced upwardwardly, for example, if struck from below at the edge remote from the wall. This blow tends to pivot the shelving upwardly and can result in the contents of the shelving being displaced from the shelving. This is particularly true if the shelving is in a confined area, in which it is difficult to maneuver, and the objects placed on the shelving are relatively light so that minor bumps of the shelving at the outer edge can cause displacement.

The art has attempted to correct this tendency in such shelving primarily by utilizing multiple fasteners attached to the shelving itself and to the vertical supports at a plurality of locations near the rearmost edge of the shelving. This solution requires an extremely stiff fastening member in order that a sufficient moment can be created at the rearmost edge of the shelf to prevent displacement of the shelf upwardly. Where wire shelving is employed, the rear portion of the shelving itself may not be sufficiently strong to develop enough of a corrective moment to prevent displacement of the shelf and, as a result, the shelving itself may be damaged. Alternately, with prior art methods, the shelving must be made very stiff so that the material can develop a sufficient corrective moment. This adds additional weight and cost to the installation.

Applicant has devised a wire shelf and bracket assembly which does not require an inordinate amount of material to provide a strong, stiff assembly and which will act to prevent upward displacement of the front edge of the shelving when struck at the front edge of the assembly in an upward direction. Applicant's shelving assembly is light, inexpensive, and stable and can conveniently be installed and used as a auxiliary shelving in a variety of uses, such as household auxiliary shelving.

DESCRIPTION OF THE DRAWINGS

A better understanding of the present invention may be had by referring to the following detailed description, and the accompanying drawings. In the drawings like reference characters refer to like parts throughout the several views and in which.

DETAILED DESCRIPTION OF THE INVENTION

Figure 1:
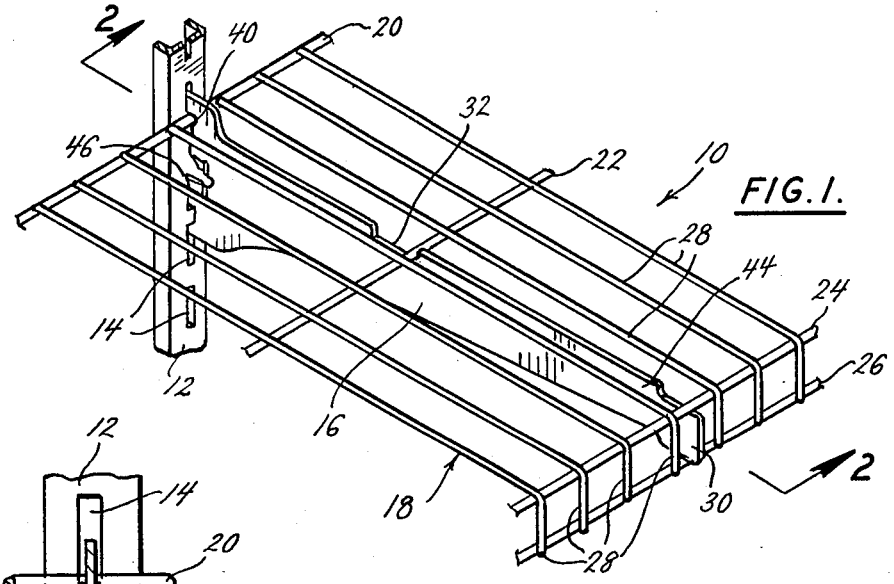
FIG. 1 is a broken isometric view of applicant's shelf support and shelving assembly.
Figure 3:
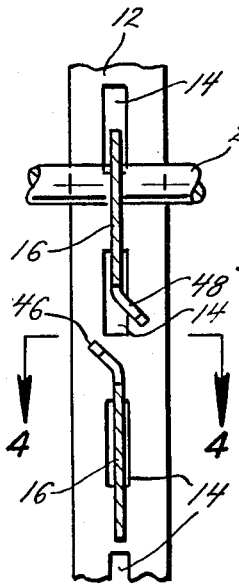
FIG. 3 is a cross sectional view, taken along the plane of line 3—3 of FIG. 2.
Figure 4:
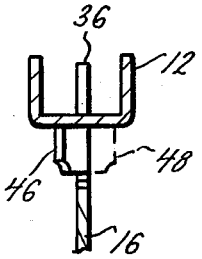
FIG. 4 is a partial cross sectional view, taken in the plane of line 4—4 in FIG. 3.
Figure 5:
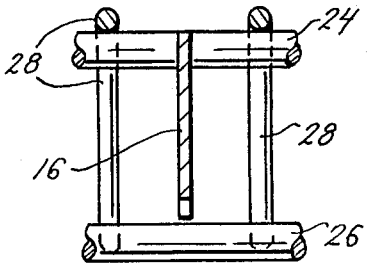
FIG. 5 is a broken cross-sectional view, taken along the plane of line 5—5 in FIG. 2.

With reference to FIG. 1, applicant's shelf assembly 10 is shown. Assembly 10 has a vertical shelf support 12 of the type which may be screwed into a wall, not shown. Vertical shelf support 12, has a plurality of slotted openings 14 spaced vertically (along the major axis) of shelf support 12. Cooperating with shelf support 12 is a horizontally extending shelf support 16 which fits in the slots 14 of vertical support 12, as shown and described herein. It will be understood that a plurality of shelf supports 12 and 16 will be employed in a complete shelf assembly 10.

As shown FIG. 1, a wire shelf 18 is mounted on and cooperates with, shelf supports 12 and 16, as further shown and described herein. Shelf 18 has a plurality of support wires 20, 22, 24 and 26 which form the support structure of shelf 18. Wires 20, 22, 24 and 26 extend transversely to shelf support 16 and cooperate therewith, as further described herein. Shelf wires 20, 22 and 24 are spaced in a horizontal plane and form the support for the main horizontal surface of the shelf 18. The upper surface of shelf 18 is further formed by a plurality of stringer wires 28, which are joined to wires 20, 22, 24 and 26, as shown, and further form the upper surface of the shelf 18. Wire 26 is spaced vertically below wire 24 and extends parallel thereto. Stringer wires 28 terminate at the outer extremity of the shelving at a right angle, forming an L shape that extends from wire 24 down to wire 26. Wires 28 are connected to all points of contact with wires 20, 22, 24 and 26. The result of the described structure is to form a depending web in the extremity of the shelf 18, greatly increasing the strength and rigidity of the shelving at a minimal increase in weight and cost.

Figure 2:
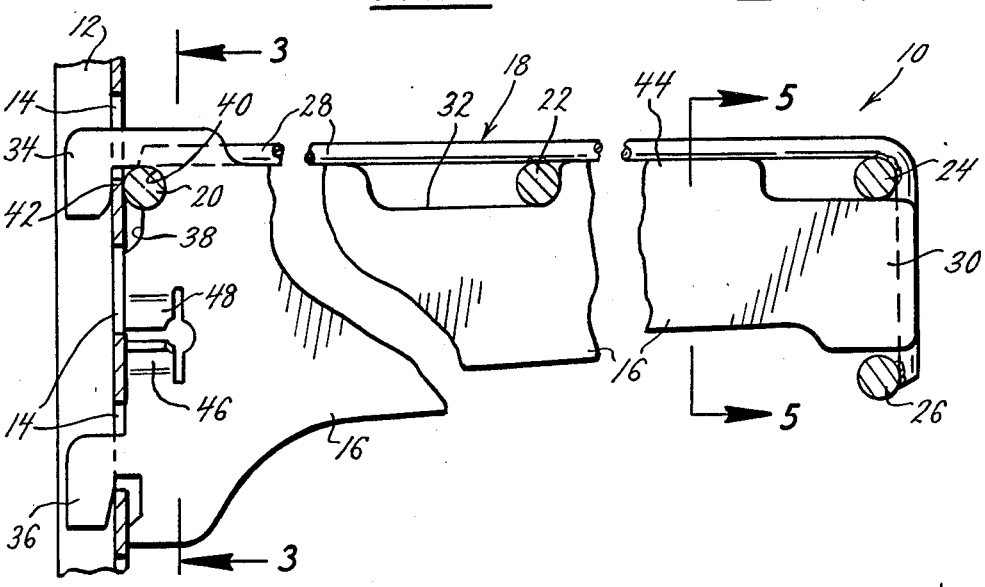
FIG. 2 is a partial broken cross sectional view of the shelving assembly shown in FIG. 1, taken along the plane of line 2—2 in FIG. 1.

The placement of wires 24 and 26 in cooperation with the end 30 of shelf support 16 also acts to prevent upward vertical displacement of the shelf 18, as described herein. As shown in FIG. 2, end 30 of shelf bracket 16 fits between support wires 24 nd 26. End 30 of shelf bracket 16 is sized to substantially occupy the vertical space between wires 24 and 26 and to be closely adjacent to wires 24 and 26. Normally, wire 24 rests on the upper surface 32 at the end 30 of shelf bracket 16 and is supported thereby. Lower wire 26 is spaced just below the end 30 of shelf bracket 16 with only enough clearance to allow convenient assembly of the shelf and bracket assemblies. This configuration allows the shelf bracket 16 to restrain shelf 18 when struck by a force tending to move the shelf 18 upwardly. The intermediate support wire 22 may also be supported on the upper surface 32 of shelf bracket 16, as shown.

Shelf bracket 16 joins the vertical support 12 at the wall, not shown, and is connected thereto by hooks 34 and 36 which fit through slots 14 in vertical support 12, as shown. Hooks 34 and 36 thus provide a connection with support 12 which converts the shelf bracket 16 into a cantilever support which provides both vertical support to the shelf and any contents thereon and torsional ridigity preventing downward rotation of the shelf under load. With the cooperation of support wires 24 and 26, supports 12 and 16 prevent upward displacement of the shelf 18, as well. Shelf 18 is secured against horizontal displacement in a direction parallel to the shelf bracket 16 and away from the wall, and support structure 12 mounted thereon, by the retaining slot 38 in the rearward portion of shelf bracket 16 near hook 34. Slot 38 is formed as a curve through which wire 20 may be inserted and has a terminal curved portion 40 to at least partially conform to the curvature of wire 20, as shown. When assembled, wire 20 is held within slot 40 by the portion 42 of vertical support 12 adjacent to a slot 14. Hook 34 extends through the slot 14 and around support portion 42, as shown, to form a firm connection and retain wire 20 in portion 40, as shown. Portion 40 thereby connects wire 20 firmly to the shelf bracket 16 and to vertical support 12 to prevent displacement of shelf 18 in a horizontal direction perpendicular to a wall on which support 12 is mounted. To provide additional rigidity and support preventing horizontal displacement of shelf 18, a raised portion 44 may be provided on the upper surface 32 of shelf bracket 16, adjacent to support wire 22, abutting against wire 22 to provide an additional restraining means preventing horizontal displacement of shelf 18, as shown.

To further stablize shelf bracket 16, and a shelving assembly using shelf bracket 16, a set of transversely extending supports 46 and 48 may be formed in shelf bracket 16, as shown. Supports 46 and 48 lie closely adjacent to vertical support 12, when shelf bracket 16 is positioned thereon, and provide transverse stability to shelf bracket 16 by bracing shelf bracket 16 against side-to-side motion.

In operation, a plurality of vertical supports 12 are mounted on a wall or other surface with a cooperating number of shelf brackets 16 mounted thereon. A shelf 18 is mounted in the assembly supported by shelf brackets 16 at a plurality of horizontal locations. Support wire 20 of shelf 18 is retained in portions 40 of the shelf brackets 16. Wires 22 and 24 rest on the upper surfaces 32 of shelf brackets 16. Wires 24 and 26 are positioned around the ends 30 of shelf brackets 16. The total assembly forms a stable and strong shelf assembly 10 restrained against horizontal and vertical displacement as described herein.

Although particular preferred embodiments of the invention have been disclosed in detail for illustrative purposes, it will be recognized by those skilled in the art that variations of modifications in the disclosed device may be made. Applicant intends not to be limited by the embodiments disclosed herein, but only by the scope of the claims appended hereto.

I claim:

1. In a shelf assembly of the type having a generally vertical support, a unitary cantilever support and a wire shelf mounted thereon the wire shelf having a first edge, the cantilever support having a first end and a second end remote therefrom, means joining the first end to the generally vertical support with the second end spaced therefrom, the improvement comprising means interengageable between the wire shelf and the second end of the cantilever support preventing upward displacement of the wire shelf when mounted in the assembly and wherein the cantilever support has means trapping the first edge of the wire shelf between the cantilever support and the vertical support and preventing displacement of the shelf.

2. The shelf assembly of claim 1 wherein the cantilever support has means for engaging the generally vertical support to block pivotal movement of the cantilever support about a generally vertical axis.

3. The shelf assembly of claim 1 wherein the shelf assembly includes means independent of the interengageable means for preventing horizontal displacement of the wire shelf.

4. A shelf assembly having a generally vertical perforated support, a cantilever support mounted in the perforations of the vertical support and extending outwardly therefrom and a wire shelf mounted in the assembly and supported on the cantilever support, the cantilever support having a first end joining the vertical support and a second end remote therefrom, the wire shelf having a first edge adjacent to the vertical support and a second edge remote therefrom, the wire shelf having a downwardly depending web at the second edge of the wire shelf, the downwardly depending web trapping the second end of the cantilever support therein, the web and the trapped end of the cantilever support preventing upward displacement of the second edge of the wire shelf, the cantilever support having a plurality of hook fasteners at the first end thereof extending through the perforations of the vertical support and joining the cantilever support to the vertical support, the hook fasteners being vertically spaced along the first end of the cantilever support, the cantilever support having at its first end a curved recess adjacent to the uppermost of the hook fasteners, the wire shelf having a plurality of wires extending in the plane of the shelf, the curved recess having a portion conforming to the curvature of a wire at the first edge of the wire shelf and trapping said wire at the first edge of the wire shelf against the vertical support and preventing displacement of the wire shelf, the cantilever support having an upper surface, the upper surface of the cantilever support having an extension and preventing displacement of the wire shelf, the cantilever support having outwardly extending webs at its first end, the webs extending transversely to a plane defined by the cantilever support, the outwardly extending webs being adjacent to the vertical support and abutting against the vertical support, the outwardly extending webs preventing sway of the cantilever support whereby a stable wire shelf assembly is formed.

5. In a shelf assembly of the type having a generally vertical support, a unitary cantilever support and a wire shelf mounted thereon, a first edge of the wire shelf, the cantilever support having a first end joining the vertical support and a second end remote therefrom and supporting a portion of the shelf at a point spaced from the vertical support, the improvement comprising means trapping the first edge of the wire shelf between the cantilever support and the vertical support and preventing displacement of the shelf.

6. In a shelf assembly of the type having a generally vertical support, a cantilever support having a first end joining the vertical support and a second end remote therefrom, and a wire shelf mounted on the cantilever support, the shelf comprising a plurality of stringers extending between and supported by a first edge wire and a second edge wire, the first edge wire being adjacent the vertical support and the second edge wire being spaced from the vertical support, the improvement comprising means for trapping the first edge wire of the wire shelf between the first end of the cantilever support and the vertical support to prevent displacement of the shelf.

7. The shelf assembly of claim 6 wherein there are openings in the vertical support and there are hooks on the first end of the cantilever support for engaging the openings, and wherein the slot in the first end of the cantilever support is adjacent one of the hooks.

8. In a shelf assembly of the type having a generally vertical support, a cantilever support having a first end joining the vertical support and a second end remote therefrom, and a wire shelf mounted on the cantilever support, the shelf comprising a plurality of stringers extending between and supported by a first edge wire and a second edge wire, the improvement comprising means for trapping the first edge wire of the wire shelf between the first end of the cantilever support and the vertical support to prevent displacement of the shelf, the wire shelf further comprising a third wire parallel to and below the second edge wire, the stringers extending downwardly to said third wire to form a depending web, and further comprising means on the cantilever support for extending between the second edge wire and the third wire to prevent upward displacement of the shelf.

9. The shelf assembly of claim 8 wherein the second end of the cantilever support is sized to substantially occupy the vertical space between the second edge wire and the third wire of the shelf.

10. An improved cantilever support of the type used in a shelf assembly having vertical supports, a cantilever support having a first end joining the vertical support and a second end remote therefrom, and a wire shelf mounted on the cantilever support, the wire shelf comprising a plurality of stringers extending between and supported by a first edge wire and a second edge wire, the cantilever support having means in the first end for trapping the first edge wire between the cantilever support and the vertical support to prevent displacement of the shelf, the trapping means comprising a slot in the first end of the cantilever support, hooks in the first end of the cantilever support for engaging openings in the vertical support, the slot in the first end of the cantilever support being adjacent one of the hooks, and wherein the slot in the first end of the cantilever support is between two hooks.

* * * * *